United States Patent [19]

Brown et al.

[11] Patent Number: 4,850,947

[45] Date of Patent: Jul. 25, 1989

[54] LOCK DEVICE FOR MANIFOLD FORMS

[75] Inventors: Peter E. Brown, Everett; Robert A. Perry, St. Albert, both of Canada; Raymond S. Kubicki, North Tonawanda, N.Y.

[73] Assignee: Moore Business Forms, Inc., Grand Island, N.Y.

[21] Appl. No.: 183,051

[22] Filed: Apr. 19, 1988

[30] Foreign Application Priority Data

May 25, 1987 [CA] Canada ..... 538420

[51] Int. Cl.[4] ..... B05B 1/14

[52] U.S. Cl. ..... 493/365; 493/346; 493/351; 493/381; 156/252; 156/253; 156/267

[58] Field of Search ..... 493/346, 351, 353, 365, 493/367, 370, 381, 471; 282/11.5 A, 11.5 R; 156/252, 253, 267, 530; 83/667, 668

[56] References Cited

U.S. PATENT DOCUMENTS

| | | | |
|---|---|---|---|
| 2,328,081 | 8/1943 | Johnson . | |
| 2,769,496 | 11/1956 | Spinner | 83/667 |
| 3,303,083 | 2/1967 | Hedenstrom . | |
| 3,558,159 | 1/1971 | Wakeman . | |
| 3,810,809 | 5/1974 | Herd et al. . | |
| 3,856,196 | 12/1974 | Bayne et al. . | |
| 4,114,869 | 9/1978 | Gladow et al. | 493/346 |
| 4,173,359 | 11/1979 | Sornberger . | |
| 4,182,526 | 1/1980 | Poole . | |
| 4,260,444 | 4/1981 | Fowler | 282/11.5 R |
| 4,307,897 | 12/1981 | Sarkans et al. . | |
| 4,426,242 | 1/1984 | Sarkans et al. . | |
| 4,462,292 | 7/1984 | Pearl | 83/668 |

*Primary Examiner*—Frederick R. Schmidt
*Assistant Examiner*—Robert Showalter
*Attorney, Agent, or Firm*—Nixon & Vanderhye

[57] ABSTRACT

Apparatus for processing multisheet or manifold business forms assemblies comprises at least one pair of rotary slitters, a male crimping die or punch associated with one of the slitting blades of the pair for rotation therewith, and a female crimping die or punch receptacle associated with the other of the slitting blades for rotation therewith. Upon rotation of the slitters and their associated crimping dies, the manifold assembly is concurrently slit and crimped to produce locks or paper staples in the body of the assembly. These paper staples effectively hold the various sheets of the assembly in registration or alignment during subsequent processing, but readily permit separation of the various sheets of the assembly when desired.

12 Claims, 1 Drawing Sheet

LOCK DEVICE FOR MANIFOLD FORMS

This invention relates to apparatus for processing multisheet or manifold business forms assemblies, and particularly relates to crimping devices for at least temporarily locking or securing the various sheets of the assembly in registration or alignment during processing, and after detachment of individual forms units from a continuous assembly.

Continuous business forms in manifold sets of assemblies are normally provided to customers in zigzag stacks or circular rolls for ease of handling and delivery to business machinery for processing. Such assemblies, during processing, are usually slit along the edge to eliminate unwanted marginal material, separated into individual form sets in a detacher as illustrated in Bayne et al, U.S. Pat. No. 3,856,196, issued Dec. 24, 1974, and subsequently sealed to produce a mailing unit, or for other purposes. However, as the forms are processed through the detacher, and subsequently prior to sealing, there is some risk that sheets of the forms assembly will shift longitudinally relative to one another resulting in misregistration between sheets of the assembly. Even slight misregistration or misalignment can create problems upon sealing, such as buckling, distortion, and even premature tearing open of the sealed assembly. Such misregistration or misalignment can also create problems at the receiving end of the document, in that, if, for example, lines of perforation are not properly aligned as between adjoining sheets, difficulty may be encountered in opening the sealed unit, as this is frequently accomplished by tearing off a marginal segment along lines of perforation which, ideally, are in direct alignment on two or more sheets of the sealed assembly.

It is of course possible to eliminate the misalignment problem by permanently connecting the sheets of the assembly as by glueing or the like. However, this may be undesirable for many types of forms in which ease of separation between sheets is an important criteria. There are also means for temporarily adhering sheets of such assembly together, while maintaining ease of separation, such as through the use of special glues which do not create a permanent bond, or through the use of so-called paper locks or paper staples. However, means for so connecting such sheets have hitherto been accomplished in a separate processing step, with the aid of a separate device designed for the purpose, with the result that incorporation of such device in the processing apparatus conventionally employed by a relatively small business forms customer greatly increases the complexity, size, and expense of the equipment required, and is therefore undesirable.

In accordance with the present invention, it is possible to provide a temporary paper lock or paper staple in manifold business forms assemblies in conjunction with the slitting operation, wihtout affecting in any significant way the size of the processing apparatus, and utilizing existing processing equipment with only slight modification. Accordingly, it is possible to eliminate the problems caused by misregistration or misalignment between sheets of an assembly even in smaller machines where space is at a premium.

This is accomplished, by providing, in conjunction with pairs of rotary slitters or slitting blades, a male crimping die or punch associated with one of the slitting blades of the pair for rotation therewith, and a female crimping die or punch receptacle associated with the other of the slitting blades for rotation therewith, whereby, upon rotation of the slitting blades and their associated crimping dies, the manifold assembly is concurrently slit and crimped to produce paper staples in the body of the assembly. These paper staples effectively hold the various sheets of the assembly in registration or alignment during subsequent processing, but readily permit separation of the various sheets of the assembly when desired.

Preferably the crimping dies are of the type which punch and bend small segments of the assembly out of the plane of the assembly to resist the tendency of any one sheet of the assembly to shift longitudinally with respect to any other sheet of the assembly. The lock or staple is temporary in that it can be overcome by relatively slight force when it is desired to separate the individual sheets of the assembly.

In drawings which illustrate the invention,

Figure 1:
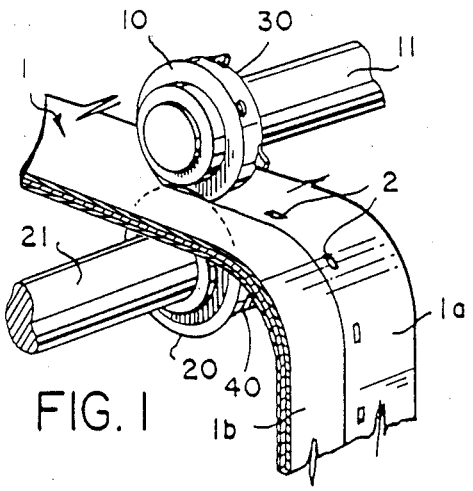
FIG. 1 is a perspective view of a pair of rotary slitting blades and associated crimping dies acting on a manifold forms assembly.

Referring now to the drawings, FIG. 1 illustrates a pair of conventional rotary slitting blades 10 and 20 acting on a multisheet or manifold forms assembly 1 to separate a marginal strip 1*b* from the body of the forms assembly 1*a*. Associated crimping dies 30 and 40 are mounted for rotation with the slitting blades 10 and 20 to concurrently produce a series of paper staples 2 in the body portion 1a, which temporarily maintain the various sheets of the assembly in alignment during subsequent processing.

Figure 2:
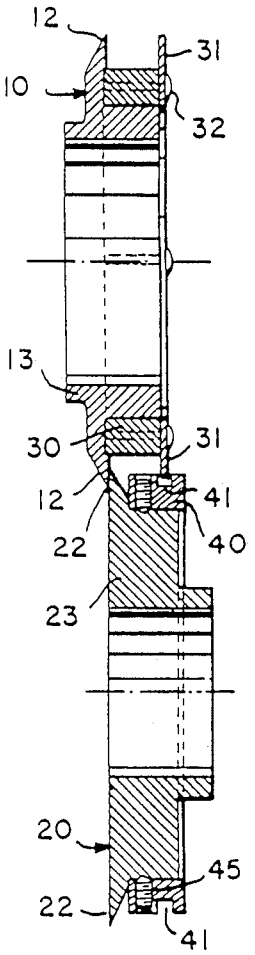
FIG. 2 is a cross-section of a pair of rotary slitting blades and associated crimping dies.

Referring now to FIG. 2, it will be seen that the slitting blades 10 and 20 comprise overlapping bevelled blade elements having continuous surfaces 12 and 22 respectively, which are adapted to slit a forms assembly passing therebetween by shearing action. The slitting blades 10 and 20 also include central hub elements 13 and 23 respectively adapted for mounting of the blades on driven axles 11 and 21 respectively, as illustrated in FIG. 1. The hubs may be secured to the driven axles by any conventional means, such as by set screws, which form no part of the invention and are not illustrated in the drawings.

Figure 3:
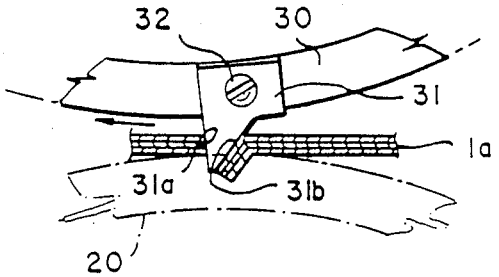
FIG. 3 is a detail side view, partially in section, showing cooperation of the crimping dies to produce a paper staple.

The upper crimping die 30, in the illustrated embodiment, is in the form of an annular collar adapted to seat snugly on the hub 13, axially inboard of the slitting blade 10 and securable thereto by means of set screws (not specifically illustrated). In the embodiment illustrated, die 30 is the male die and carries thereon a plurality of crimping elements in the form of punches 31 which, as best seen in Figure 3, have a straight leading face 31*a*, a sloping trailing face 31b and are secured to a face of the collar 30 by means of screws 32. Normally the crimping punches 31 will be spaced equi-distantly about the collar 30. The numbers of such elements will depend upon the frequency and spacing of the paper staples desired in the forms ssembly. However, three or four such elements are typical, although, conceivably, one only could be utilized if desired.

The female crimping die 40 is also in the form of a collar which seats snugly on the hub 23, axially inboard of the slitting blade 20, and is secured for rotation therewith by means of at least one set screw such as that illustrated at 45 in FIG. 2. The collar 40 is provided with a receptacle in the form of a circumferential groove 41 adapted to freely receive the free terminal ends of the crimping punches 31 as illustrated in FIG. 2. It will be appreciated that, instead of a circumferential groove 41, it would be possible to produce a plurality of discrete grooves about the periphery of collar 40 which, upon rotation of the slitting blades, and hence the male and female crimping dies, would cooperate with the free terminal ends of the male crimping elements as depicted in FIG. 2. However, it would then be necessary to ensure that the upper and lower crimping dies rotate in appropriately timed relationship such that a free terminal end of a male element comes into contact with a discrete groove of the female die at the right instant, and it would also be necessary to ensure that the number of such discrete grooves or slots coincide with the number of male crimping elements. The use of a continuous circumferential slot 41 eliminates such unnecessary refinements, as the same female die may be used regardless of the number of male crimping elements on the male die, and the continuous circumferential groove is therefore preferred.

The operation of the crimping dies is best illustrated in FIG. 3, where it will be seen that, upon rotation of the die elements, the outer surface of the female die 40 supports the underside of the web 1a in the illustrated embodiment, and the crimping punch 31 on the male die, in cooperation with groove 41 the female die, strikes a relatively small discrete element of the web out of the plane of the web to produce a form of interlock between the various sheets of the web, which is sufficient to maintain the various sheets in longitudinal alignment or registry during further processing of the web, but which nevertheless permits the sheets of the web to be separated subsequently, when desired, with relatively little force.

It will be apparent that the temporary locking or stapling of the various sheets of a manifold business forms assembly may be accomplished as previously described, using existing equipment with little or no modification. It is only necessary to connect collars comprising male and female crimping dies to the hubs of conventional rotary slitting blades. Such can be accomplished quickly and easily by means of the set screw attachment illustrated in FIG. 2. No additional space is required, nor is it necessary to add an additional unit or section to an existing manifold forms assembly processor to accomplish the temporary interlock between the various sheets of a manifold forms assembly. Additionally, if for any reason the temporary paper lock or staple is not required in the processing of manifold forms assemblies, the crimping dies can readily be removed simply by withdrawing the set screws, and sliding the collars 30 and 40 off the slitting blade hubs 13 and 23 respectively. It is also a simple matter to change, for example, a male die only, to provide for a greater or lesser number of crimping elements 31 to thus increase or decrease the number of paper staples applied to the forms assembly per unit of length. No change in the female die is necessary if a continuous circumferential groove 41 is employed. It is only necessary to withdraw the holding set screws, slide off the existing male die collar 30, and replace it with a corresponding die collar which bears the desired number of crimping elements 31.

It will also be appreciated that it would be a simple matter to produce each rotary slitting blade and associated crimping die as a unitary element. However, the use of separate crimping dies in the form of collars readily securable and detachable to the slitting blade hubs permits great flexibility with minimal additional expense, and therefore constitutes the preferred form of the invention. Many other alterations and modifications may, of course, be made in the subject matter herein disclosed without deviating from the intended scope of the invention.

What is claimed is:

1. Apparatus for processing a manifold web assembly, comprising:

cooperating slitting means for slitting a web assembly passing therebetween, each said slitting means comprising a rotatable blade support having a circular slitting blade with a continuous cutting surface secured thereto for rotation therewith, and web assembly crimping means disposed on each said blade support for rotation therewith; and one said crimping means disposed on one of said blade supports comprising at least one projecting male crimping element, having a free terminal end of which is adapted to intercept the plane of said web assembly, and another said crimping means disposesd on another of said blade supports comprising at least one female receptacle adapted to freely receive the free terminal end of said male crimping element so as to concurrently slit said web assembly and strike a plurality of discrete segments of said assembly from the plane of said assembly.

2. Apparatus for processing a manifold web assembly, comprising:

a pair of cooperating slitting means for slitting a web assembly passing therebetween to separate a marginal part of the assembly from a body portion thereof, each said slitting means comprising a rotatable cylindrical blade support having a circular slitting blade secured at one end thereof for rotation therewith, and male and female manifold web assembly crimping means disposed on respective ones of said blade supports for rotation therewith; said male crimping means comprising at least one male crimping element projecting radially outwardly with respect to its associated cylindrical blade support and disposed to one side of said slitting blade overlying the body portion of said manifold web assembly, a free terminal end of said male crimping element adapted to intercept the plane of said web assembly upon rotation of said male crimping means; and said female crimping means comprising at least one female receptacle adapted to freely receive the free terminal end of said male crimping element, so as to concurrently slit said web assembly and strike from the plane of said assembly a plurality of discrete elements of said assembly to at least temporarily interlock the webs of said body portion of said assembly together.

3. Apparatus as defined in claim 2 wherein said male crimping means comprising an annular collar encircling its associated cylindrical blade support and secured thereto for rotation therewith, and a plurality of said male crimping elements.

4. Apparatus as defined in claim 3 wherein the leading edge of each male crimping element projects radially outwardly from the circumference of said collar, and said trailing edge slopes radially outwardly toward said leading edge.

5. Apparatus as defined in claim 3 wherein said female crimping member comprises an annular collar encircling its cylindrical blade support and secured thereto for rotation therewith.

6. Apparatus as defined in claim 5 wherein said female receptacle comprises a continuous circumferential groove disposed in the outer surface of said female crimping member collar and in alignment with said male crimping element.

7. Apparatus as defined in claim 6 wherein said collars are secured to their cylindrical blade supports by at least one set screw.

8. Apparatus as defined in claim 2 wherein there are four male crimping elements.

9. Apparatus as defined in claim 3 wherein there are four male crimping elements.

10. Apparatus as defined in claim 6 wherein there are four male crimping elements.

11. Manifold web assembly processing apparatus, comprising:

upper and lower cooperating slitting blade units, each blade unit comprising a rotatable hub and an annular slitting blade projecting radially outwardly from one end of said hub;

a collar surrounding each of said hubs and secured thereto for rotation therewith and with said annular slitting blades;

a plurality of male crimping elements projecting radially outwardly from one of said collars axially inboard of said slitting blade;

said male crimping elements having terminal ends adapted to extend beyond the plane of the manifold web assembly; and a circumferential groove formed in the other of said other collars, axially inboard of said slitting blades and in alignment with said male crimping elements, and adapted to freely receive the terminal end thereof so as to concurrently slit and crimp said web assembly.

12. Apparatus for processing a manifold web assembly, comprising:

cooperating slitting means for slitting a web assembly passing therebetween, each said slitting means comprising a rotatable blade support having a circular slitting blade secured thereto for rotation therewith, and web assembly crimping means disposed on said blade support for rotation therewith; and one said crimping means disposed on one of said blade supports in axially spaced relationship to said circular slitting blade comprising at least one projecting male crimping element, having a free terminal end of which is adapted to intercept the plane of said web assembly, and another said crimping means disposed on another of said blade supports comprising at least one female receptacle adapted to freely receive the free terminal end of said male crimping element so as to concurrently slit said web assembly and strike a plurality of discrete segments of said assembly from the plane of said assembly.

* * * * *